US005516412A

United States Patent [19]

Andricacos et al.

[11] Patent Number: 5,516,412

[45] Date of Patent: May 14, 1996

[54] VERTICAL PADDLE PLATING CELL

[75] Inventors: Panayotis C. Andricacos, Croton-on-Hudson; Kirk G. Berridge, Fishkill; John O. Dukovic, Pleasantville; Matteo Flotta, Yorktown Heights; Jose Ordonez, Pleasant Valley; Helmut R. Poweleit, Highland, all of N.Y.; Jeffrey S. Richter, Kernersville, N.C.; Lubomyr T. Romankiw, Briarcliff Manor, N.Y.; Otto P. Schick, Poughquag, N.Y.; Frank Spera, Poughkeepsie, N.Y.; Kwong-Hon Wong, Wappingers Falls, N.Y.

[73] Assignee: International Business Machines Corporation, Armonk, N.Y.

[21] Appl. No.: 441,853

[22] Filed: May 16, 1995

[51] Int. Cl.[6] ..... C25D 17/06; C25F 7/00

[52] U.S. Cl. ..... 204/224 R; 204/224 M; 204/228; 204/273; 204/275; 204/237; 204/238; 204/225; 204/DIG. 7

[58] Field of Search ..... 204/224 M, 224 R, 204/228, 273, 237–238, 275, DIG. 7, 297 W

[56] References Cited

U.S. PATENT DOCUMENTS

| | | | |
|---|---|---|---|
| 2,697,690 | 12/1954 | Beebe, Jr. | 204/297 W |
| 3,649,509 | 3/1972 | Morawetz et al. | 204/275 X |
| 3,652,442 | 3/1972 | Powers et al. | 204/273 |
| 4,022,678 | 5/1977 | Wojcik et al. | 204/273 |
| 4,102,756 | 7/1978 | Castellani et al. | 204/43 T |
| 4,304,641 | 12/1981 | Grandia et al. | 204/DIG. 7 X |
| 4,359,375 | 11/1982 | Smith | 204/DIG. 7 |
| 4,595,478 | 6/1986 | Pellegrino et al. | 204/273 |
| 4,696,729 | 9/1987 | Santini | 204/224 R |
| 5,135,636 | 8/1992 | Yee et al. | 204/DIG. 7 X |
| 5,228,967 | 7/1993 | Crites et al. | 204/228 |
| 5,312,532 | 5/1994 | Andricacos et al. | 204/231 |

OTHER PUBLICATIONS

Mehdizadeh et al, "Optimization of Electrodeposit Uniformity by the use of auxiliary Electrodes," J. Electrochem. Soc., vol. 137, No. 1, Jan. 1991, pp. 110–117.

Schwartz et al, "Mass–Transfer Studies in a Plating Cell with a Reciprocating Paddle," J. Electrochem. Soc., vol. 134, No. 7, Jul. 1987, pp: 1639–1645.

Rice et al, "Copper Electrodeposition Studies With a Reciprocating Paddle," J. Electrochem. Soc., vol. 135, No. 11, Nov. 1988, pp: 2777–2780.

Mehdizadeh et al, "The Influence of Lithographic Patterning on Current Distribution in Electrodeposition: Experimental Study and Mass–Transfer Effects," J. Electrochem. Soc., vol. 140, No. 12, Dec. 1993, pp: 3497–3505.

*Primary Examiner*—Donald R. Valentine

*Attorney, Agent, or Firm*—Stephen S. Strunck; Francis L. Conte

[57] ABSTRACT

An electroplating cell includes a floor, ceiling, front wall, and back wall forming a box having first and second opposite open ends. A rack for supporting an article to be electroplated is removably positioned vertically to close the first open end and includes a thief laterally surrounding the article to define a cathode. An anode is positioned vertically to close the second open end, with the assembly defining a substantially closed, six-sided inner chamber for receiving an electrolyte therein for electroplating the article. The article and surrounding thief are coextensively aligned with the anode, with the floor, ceiling, front and back walls being effective for guiding electrical current flux between the cathode and the anode. In a preferred embodiment, the cell is disposed as an inner cell inside an outer cell substantially filled with the electrolyte, and a paddle is disposed inside the inner cell for agitating the electrolyte therein. The rack is removable and installable vertically upwardly which allows for automated handling thereof.

21 Claims, 4 Drawing Sheets

VERTICAL PADDLE PLATING CELL

CROSS REFERENCE TO RELATED APPLICATION

This invention is related to patent application Ser. No. 08/441,852, filed May 16, 1995, entitled "Electroplating Workpiece Fixture," filed concurrently herewith.

BACKGROUND OF THE INVENTION

The present invention relates generally to plating and etching, and, more specifically, to electrodeposition of a film of uniform thickness and composition.

Electroplating is a common process for depositing a thin film of metal or alloy on a workpiece article such as various electronic components for example. In electroplating, the article is placed in a suitable electrolyte bath containing ions of a metal to be deposited. The article forms a cathode which is connected to the negative terminal of a power supply, and a suitable anode is connected to the positive terminal of the power supply. Electrical current flows between the anode and cathode through the electrolyte, and metal is deposited on the article by an electrochemical reaction.

In many electronic components it is desirable to deposit the metal film with a uniform thickness across the article and with uniformity of composition. However, the electroplating process is relatively complex and various naturally occurring forces may degrade the electroplating process. Most significantly, the electrical current or flux path between the anode and the cathode should be relatively uniform without undesirable spreading or curving to ensure uniform electrodeposition. Furthermore, as metal ions are depleted from the electrolyte, the uniformity of the electrolyte is decreased and must be suitably corrected to avoid degradation of the electroplating process. And, debris particles are generated in the chemical reactions which can degrade the metal film on the article upon settling thereon.

Conventional electroplating equipment includes various configurations for addressing these as well as other problems for ensuring relatively uniform electroplating. Suitable circulation of the electrolyte is required for promoting electroplating uniformity, and care is required for properly aligning the cathode and anode to reduce undesirable flux spreading. For example, one type of conventional electroplating apparatus mounts the cathode at the bottom of an electrolyte bathing cell, with the anode being spaced above and parallel to the cathode. Since the article is at a common depth in the cell, the electroplating process is less susceptible to vertically occurring variations in the process due to buoyancy or gravity effects or other convection effects occurring during the process. For example, ion depletion in the electrolyte adjacent to the article will create local currents which will have a common effect along the horizontal extent of the article, but can vary vertically.

And, in the electrodeposition of magnetic materials, e.g. permalloy, resulting gases are produced in the process which result in bubbles being generated at the article surface. Of course, bubbles are buoyancy driven upwardly, and horizontally positioning the article reduces adverse effects therefrom.

Enhanced uniformity in metal deposition is also typically promoted by suitable agitation of the electrolyte in the cell. However, agitation by a unidirectional flow of the electrolyte is typically undesirable since it can cause monotonically decreasing mass-transfer effectiveness along the direction of flow.

Although horizontally positioned cathodic articles typically result in relatively uniform electrodeposition, the articles are more prone to the settling thereon of debris particles which degrade the article. And, the various conventional configurations for horizontally electroplating an article have varying degrees of complexity which increases the difficulty in mass producing electrodeposition articles. It is desirable to provide not only high uniform thickness and composition in an electrodeposition article, but also do so in an apparatus capable of high-volume manufacturing, and preferably using automated handling equipment.

SUMMARY OF THE INVENTION

An electroplating cell includes a floor, ceiling, front wall, and back wall forming a box having first and second opposite open ends. A rack for supporting an article to be electroplated is removably positioned vertically to close the first open end and includes a thief laterally surrounding the article to define a cathode. An anode is positioned vertically to close the second open end, with the assembly defining a substantially closed, six-sided inner chamber for receiving an electrolyte therein for electroplating the article. The article and surrounding thief are coextensively aligned with the anode, with the floor, ceiling, front and back walls being effective for guiding electrical current flux between the cathode and the anode. In a preferred embodiment, the cell is disposed as an inner cell inside an outer cell substantially filled with the electrolyte, and a paddle is disposed inside the inner cell for agitating the electrolyte therein. The rack is removable and installable vertically upwardly which allows for automated handling thereof.

BRIEF DESCRIPTION OF THE DRAWINGS

The invention, in accordance with preferred and exemplary embodiments, together with further objects and advantages thereof, is more particularly described in the following detailed description taken in conjunction with the accompanying drawings in which.

DESCRIPTION OF THE PREFERRED EMBODIMENT(S)

Figure 1:
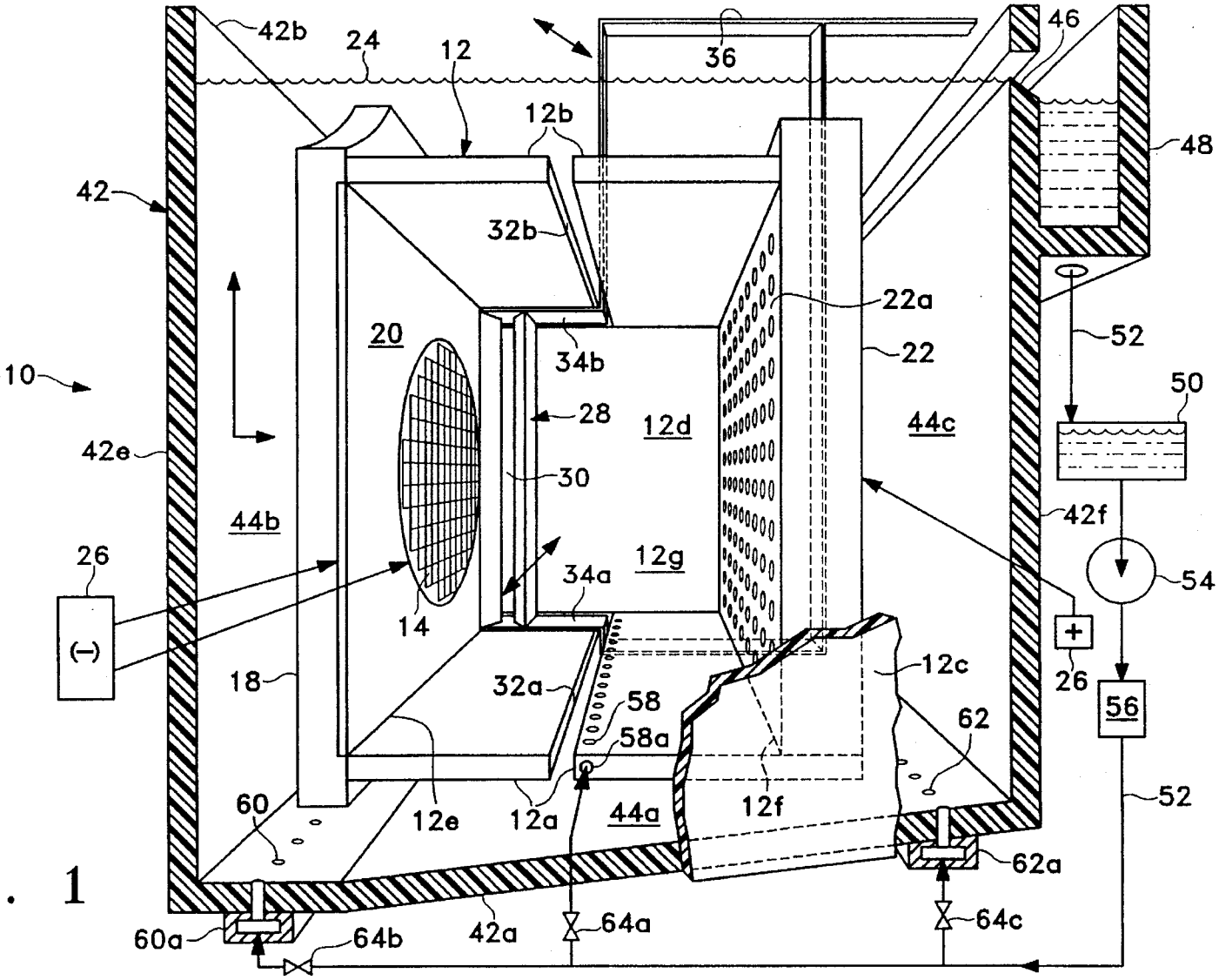
FIG. 1 is a schematic, perspective elevational view of a vertical paddle plating cell (VPPC) in accordance with one embodiment of the present invention having an article to be electroplated disposed inside an inner cell, with the inner cell being disposed inside an outer cell.
Figure 2:
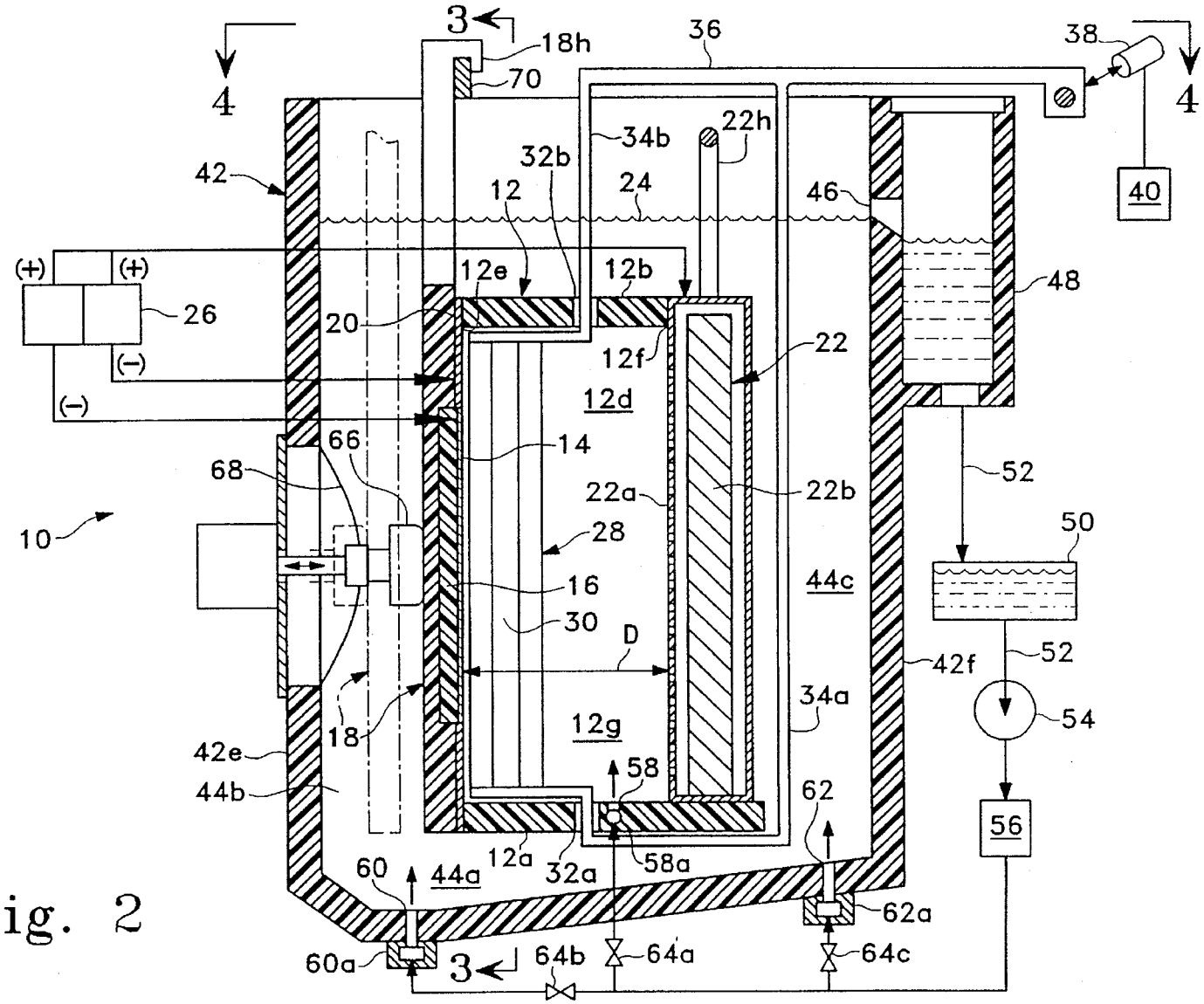
FIG. 2 is a schematic, partly sectional elevational view of the VPPC illustrated in FIG. 1.

Illustrated in FIGS. 1 and 2 are schematic, elevational views of a vertical paddle plating cell assembly (VPPC) 10 in accordance with an exemplary, preferred embodiment of the present invention. The VPPC 10 includes an inner cell 12 configured for use in electroplating a flat workpiece article 14. The article 14 may take any conventional form that requires uniform plating thickness thereon such as in recording heads, packaging modules, or integrated circuits typically used in electronic devices or computers. In the exemplary embodiment illustrated, the article 14 is a flat, circular wafer or substrate having a substantial number of individual IC chip patterns arranged suitably thereon. In one electroplating process, it is desired to electrodeposit on the several IC chips uniformly thick solder protuberances for example. In this embodiment, the article 14 is relatively fragile and is suitably supported in a dielectric holder 16 (see FIG. 2) which is preferably formed of polyvinylidene fluoride (PVDF). The holder 16 in turn is suitably supported in a plating fixture or rack 18, which is also preferably made of PVDF. A suitable thief 20 laterally surrounds the article 14 and is preferably coplanar therewith to define a conventional cathode for use in electroplating the article 14. In the exemplary embodiment illustrated, the thief is a suitable metal such as stainless steel which acts as a cathode electrode in conjunction with the article 14 itself which also acts as a cathode electrode as described in more detail below. The specific details of mounting the article 14 in its holder 16 to the rack 18 are not the subject of the present invention, and may take any suitable configuration, The inner cell 12 includes a flat floor 12*a* and a parallel flat ceiling 12*b* spaced therefrom. It also includes a flat front wall 12*c* and a parallel flat back wall 12*d* spaced therefrom, which are fixedly joined to the floor and ceiling 12*a,b* in a quadrilateral configuration or box perpendicularly intersecting each other at the corners thereof. The inner cell 12 therefore has four intersecting sides 12*a–d*, and opposite, first and second open ends 12*e* and 12*f*. The floor 12*a*, ceiling 12*b*, front wall 12*c*, and back wall 12*d* are also preferably made of a dielectric such as PVDF, which is also corrosion resistant in the electrolytic environment, The rack 18 is preferably removably positioned vertically for forming a sidewall to close the first open end 12*e*, and a suitable anode 22 is preferably removably positioned vertically for forming an opposite sidewall to close the second open end 12*f*. The anode 22 may take any conventional form, but in the preferred embodiment illustrated it comprises a box having a perforated face 22*a* which faces inside the inner cell 12 opposite the rack 18, and includes a suitable anodic material 22*b* in plate form (illustrated) or in the form of a plurality of balls if desired.

The floor 12*a*, ceiling 12*b*, front wall 12*c*, back wall 12*d*, rack 18, and anode 22 define a substantially closed, six-sided inner chamber 12*g* for receiving a suitable liquid electrolyte 24 therein for electroplating the article 14 upon establishing current flow between the cathodic article 14 and the anode 22 in a conventionally known manner.

More specifically, a conventional power supply 26, preferably a two-channel power supply, is operatively connected through a suitable electrical line to the anode 22 for providing a positive electrical potential thereat. The power supply 26 is also suitably electrically connected independently to, and using separate electrical lines, to both the article 14 and the thief 20 for providing a negative electrical potential thereat. In the preferred embodiment, the separate current flows between the anode and the thief 20, and between the anode 22 and the article 14 are related to each other in proportion to their respective surface areas in the inner chamber 12*g* which may be conventionally determined empirically. The use of a separate thief 20 around the article 14 and independently providing current thereto is conventionally known. And, any suitable arrangement for joining the power supply 26 to the article 14, thief 20, and anode 22 may be used and does not form a part of the present invention.

A significant advantage of the inner cell 12 and its orientation in space allows for the vertical orientation of both the article 14 in the rack 18, and the anode 22 which provides not only for uniform electroplating of the article 14 in its vertical orientation, but allows relatively easy installation and removal of the rack 18, with the article 14 thereon, adjacent to the inner cell 12 for allowing automated handling thereof in a high-volume manufacturing line as discussed in further detail below. In the exemplary embodiment illustrated in FIGS. 1 and 2, the article 14 and surrounding thief 20 are coplanar with each other and are coextensively aligned with or face the anode 22 within the inner cell 12; and the floor 12*a*, ceiling 12*b*, front wall 12*c*, and back wall 12*d* are formed of a dielectric material (e.g, PVDF) for guiding electrical current flux through the electrolyte 24 in the inner chamber 12*g* and between the anode 22 and the cathode defined by the article 14 and thief 20 without undesirable curvature or spreading thereof.

Figure 3:
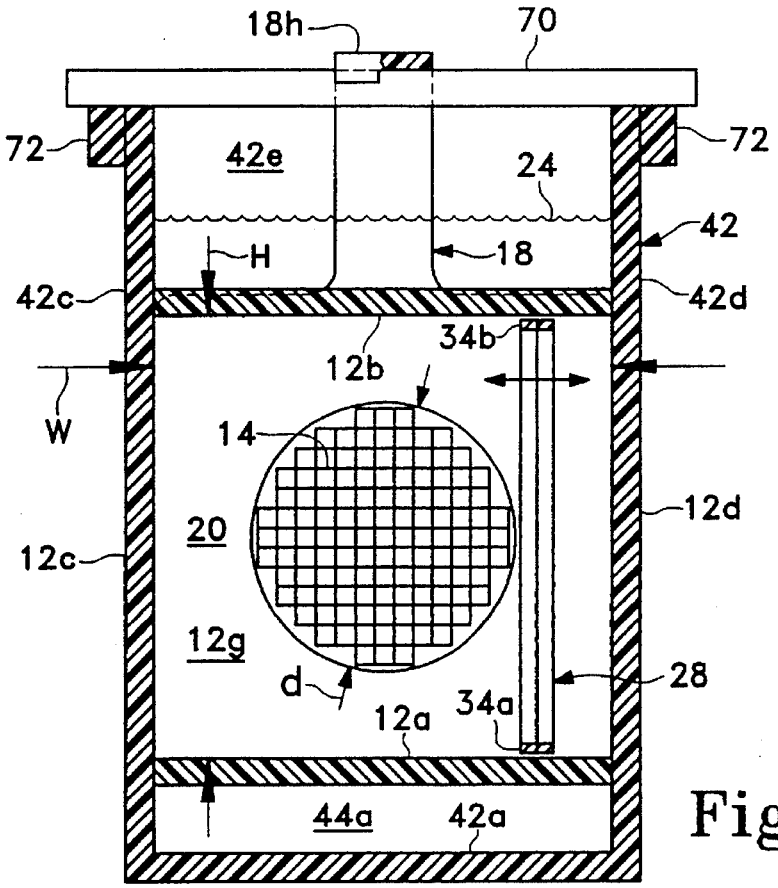
FIG. 3 is an elevational, partly sectional view of the VPPC illustrated in FIG. 2 and taken along line 3—3.

In the preferred embodiment illustrated in FIGS. 1 and 3, a single article 14 is preferably supported on the rack 18 symmetrically relative to the floor 12*a*, ceiling 12*b*, front wall 12*c*, and back wall 12*d*, with the individual IC chip patterns on the article 14 being positioned suitably thereon. In this exemplary embodiment, the article 14 has a circular perimeter and is centered within the thief 20, with the thief 20 being square in configuration, and the article 14 being equidistantly spaced from all four sides 12*a–d*. As shown in FIG. 3, the width W of the thief 20 and the article 14 therein within the inner chamber 12*g* is equal to the height H thereof, and in an exemplary embodiment define a square having sides of about 30 cm. The cathode is therefore relatively large and accommodates relatively large articles 14 having a width, e.g. an outer diameter d for a circular article 14, of about 20 cm. In this way, the four sides 12*a–d* establish a symmetric square channel between the anode 22 and the cathode, and act as flux guides for preventing undesirable spreading of flux which would otherwise lead to nonuniformity in electroplating of the article 14.

Since the article 14 is preferably disposed vertically in space, and relative to gravity, the VPPC 10 preferably also includes a paddle assembly, or simple paddle, 28 as shown in FIGS. 1–3 which is disposed vertically inside the inner chamber 12*g* and adjacent to the article 14 and rack 18. Suitable means are provided for reciprocating the paddle 28 between the front and back walls 12*c*, 12*d* for suitably agitating the electrolyte 24 inside the inner chamber 12*g* to diminish adverse plating effects from buoyancy or gravity induced convection within the inner cell 12.

The paddle 28 is in the exemplary form of a pair of vertically elongate, triangular (45°–90°– 45°) prisms having spaced apart, parallel apexes defining therebetween a throat 30 through which the electrolyte 24 is flowable. The prisms of the paddle 28 have oppositely facing, parallel, flat bases with one of the bases being disposed parallel to and closely adjacent to the article 14 or rack 18 for parallel movement over the article 14 supported therein, for example about 4.0 mm therefrom. The basic configuration of the paddle 28 is conventional except for its new vertical orientation adjacent to the vertically oriented article 14.

However, since the inner cell 12 including the rack 18 and anode 22 form a substantially closed box, suitable means must be provided for reciprocating the paddle 28 without undesirably compromising either the electrical current flux path or electrolyte agitation within the inner cell 12. In the preferred embodiment, the floor 12*a* and the ceiling 12*b* each have an elongate slot 32*a*, 32*b*, respectively extending between the front and back walls 12*c*, 12*d* and parallel to the rack 18 and the article 14 therein. In the exemplary embodiment illustrated, both the floor 12*a* and the ceiling 12*b* are preferably two-piece members, with the pieces being spaced apart from each other to define the respective slots 32*a,b*. Also in the preferred embodiment, the slots 32*a,b* are located substantially equidistantly between the article 14 and the anode 22 to minimize any adverse effects with electroplating chemical reactions occurring at both the article 14 and the anode 22.

Since the paddle 28 is disposed adjacent to the article 14, and the slots 32*a,b* are disposed in the middle of the floor 12*a* and ceiling 12*b*, a bottom arm 34*a* is fixedly joined to the paddle 28 at the bottom ends of both prisms thereof and initially extends parallel to the floor 12*a* and then jogs vertically downwardly through the floor slot 32*a*. A top arm 34*b* is similarly fixedly joined to the paddle 28 at the top ends of the two prisms thereof, and initially extends parallel to the ceiling 12*b* and then jogs vertically upwardly through the ceiling slot 32*b*. Both the bottom and top arms 34*a,b* are preferably relatively flat and thin within the inner cell 12 and extend vertically downwardly and upwardly away therefrom. The top arm 34*b* extends vertically upwardly to a horizontally extending crossbar 36 fixedly joined thereto, and the bottom arm 34*a* jogs again horizontally below the floor 12*a* and then jogs vertically upwardly along the outside surface of the anode 22 to also fixedly join the crossbar 36 at an intermediate portion thereof.

Figure 4:
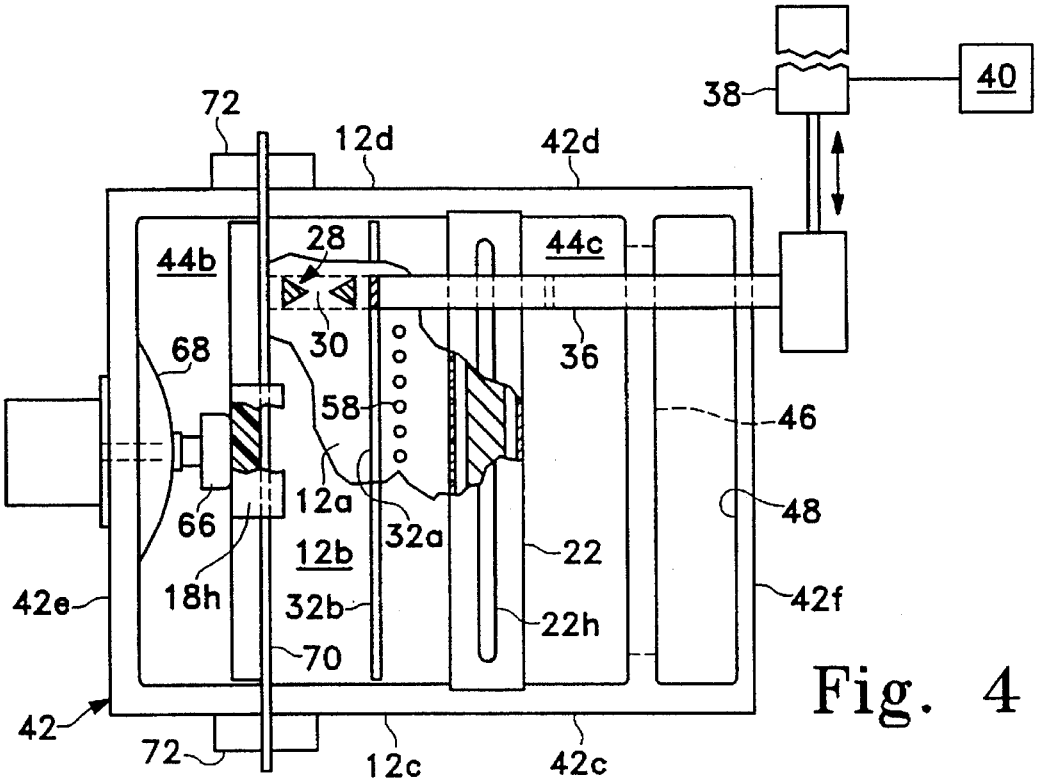
FIG. 4 is a top view of the VPPC illustrated in FIG. 2 and taken along line 4—4.

As shown in FIGS. 2 and 4, a suitable actuator 38 is operatively joined to the crossbar 36 and is effective for translating the crossbar 36 back-and-forth above the ceiling 12*b* for correspondingly reciprocating the paddle 28 inside the inner chamber 12*g*. The actuator 38 is preferably in the form of a conventional stepping motor and a suitable computer controller 40 is effective for controlling the actuator 38 to translate the paddle 28 from the front wall 12*c* to the back wall 12*d* with a predetermined velocity profile as the paddle 28 travels over the article 14 in the rack 18. In the preferred embodiment, the velocity profile of the paddle 28 is trapezoidal with a rapid linear acceleration at one of the walls 12*c,d*, a constant velocity between the walls 12*c,d*, and a rapid linear deceleration at the other of the walls 12*c,d*. The frequency of reciprocation is within an exemplary range of about 0.5–2.0 Hz, with 0.88–1.0 Hz being preferred. Accordingly acceleration and deceleration of the paddle 28 preferably occurs closely adjacent to each of the walls 12*c,d*, within about 25 millimeters thereof, for example with constant velocity of the paddle 28 occurring over the entire extent of the article 14 as well as for a suitable distant adjacent thereto.

Referring again to FIGS. 1 and 2, the inner cell 12 is preferably disposed inside a five-sided outer cell or chamber 42 having a preferably sloping floor 42*a*, and a preferably open top 42*b* without a ceiling, although a removable cover may be used thereover if desired. The entire outer cell 42 is made of a suitable dielectric and corrosion resistant material such as PVDF. As shown in FIGS. 3 and 4, the outer cell 42 includes a front wall 42*c* which is preferably coextensive with the inner cell front wall 12*c* which is integrally disposed in the middle thereof, and a corresponding back wall 42*d* which is similarly coextensive with the inner cell back wall 12*d* which is preferably integrally formed in the middle thereof. The outer cell 42 also includes first and second sidewalls 42*e*, 42*f* extending vertically upwardly from opposite ends of the outer cell floor 42*a* and above the inner cell 12 as shown more particularly in FIGS. 1 and 2. The outer cell floor 42*a* is preferably spaced below the inner cell floor 12*a* to define a bottom sub-chamber or cavity 44*a*. The outer cell first sidewall 42*e* is preferably spaced horizontally from the inner cell first open end 12*e* and the rack 18 positionable thereat to define a first sub-chamber or cavity 44*b*. And, the outer cell second sidewall 42*f* is preferably spaced horizontally from the inner cell second open end 12*c* and the anode 22 positionable thereat to define a second sub-chamber or cavity 44*c*. The bottom, first and second cavities 44*a–c* have common boundaries for allowing free flow of electrolyte therebetween, and the outer cell 42 is preferably filled with the electrolyte 24 to a level at an elevation above the inner cell 12 for completely filling the inner chamber 12*g* of the inner cell 12 with the electrolyte 24 and providing a suitable cover of the electrolyte 24 above the inner cell 12. In this way, the electrolyte 24 provides a thermal bath or jacket around the inner cell 12 which is effective for thermally conducting heat therebetween. Furthermore, the inner cell 12 may be maintained fully flooded without entrapment of air therein during operation of the paddle 28 which agitates the electrolyte 24 within the inner cell 12 during operation.

As shown in FIGS. 1 and 2, the VPPC 10 preferably further includes a horizontally elongate outlet weir 46 disposed in the outer cell second sidewall 42*f* at an elevation suitably above the inner cell 12. A corresponding outlet trough 48 is fixedly joined to the outer cell second sidewall 42*f* at the top thereof in flow communication with the outlet weir 46 for receiving overflow of the electrolyte 24 therefrom. Suitable means are provided for bathing or filling the inner and outer cells, 42 with the electrolyte 24 to the desired elevation above the inner cell 12 for providing overflow discharge from the outlet weir 46 to continuously recirculate the electrolyte 24 through the inner cell 12, as well as through the outer cell 42. A suitable external reservoir 50 is provided suitably remote from the VPPC 10 for storing as well as providing a suitable source of the electrolyte 24. One or more suitable flow conduits 52 join the outlet trough 48, the reservoir 50, and the inner cell 12 in a closed-loop fluid circuit for recirculating the electrolyte 24. A suitable pump 54 is disposed in the flow conduit 52 between the inner cell 12 and the reservoir 50 for continuously recirculating the electrolyte 24 in the fluid circuit. A suitable filter 56 is also disposed in the flow conduit 52 between the pump 54 and the inner cell 12 for filtering the electrolyte 54 prior to return thereof to the inner cell 12. Suitable temperature control of the electrolyte 24 is typically also provided for providing suitably clean electrolyte 24 at the preferred temperature in a conventionally known manner.

In order to provide the electrolyte 24 directly to the inner cell 12, a plurality of first inlet holes 58 are disposed vertically in the inner cell floor 12*a* adjacent to the floor slot 32*a* and generally equidistantly between the cathode and the anode 22. The first inlet holes 58 in one embodiment are about 3 mm in diameter and are preferably spaced apart from each other at about 13 mm, and are colinearly aligned parallel to the floor slot 32*a* for uniformly discharging the electrolyte 24 vertical upwardly into the inner chamber 12*g*. A suitable manifold 58*a* in the exemplary form of a tube extends through the floor 12*a* for providing electrolyte 24 to all of the first inlet holes 58. The manifold 58*a* is in turn suitably joined to the flow conduit 52. The electrolyte 24 primarily enters the inner cell 12 through the first inlet holes 58 in the floor 12*a* thereof, with the ceiling slot 32*b* also providing an outlet from the inner cell 12 for discharging the electrolyte 24 therefrom and into the top of the outer cell 42 below the electrolyte level therein.

The electrolyte 24 is also preferably independently supplied to the outer cell 42 by, for example, a plurality of spaced part and linearly aligned second inlet holes 60 disposed in the outer cell floor 42*a* below the first side cavity 44*b* and in flow communication with the filter 56 for receiving the electrolyte 24 therefrom. A suitable manifold 60*a* provides the electrolyte to all of the second inlet holes 60, with the manifold being suitably joined to the conduit 52.

Preferably a plurality of spaced apart and linearly aligned third inlet holes 62 are disposed in the outer cell floor 42*a* below the second side cavity 44*c* and in flow communication with the filter 56 for receiving the electrolyte 24 therefrom. A suitable manifold 62*a* provides the electrolyte 24 to all of the third inlet holes 62 and is disposed in flow communication with the conduit 52. The size and spacing of the second and third inlet holes 60, 62 may be preferably equal to those of the first inlet holes 58.

The second and third inlet holes 60, 62 independently provide electrolyte 24 into both sides of the outer cell 42 and therefore ensure circulation therein for reducing the likelihood of dead or stagnant flow zones therein. The outer cell floor 42*a* preferably slopes downwardly from the second sidewall 42*f* to the first sidewall 42*e* to prevent stagnation of the electrolyte 24 in the bottom cavity 44*a*.

The flow conduit 52 preferably also includes respective valves 64*a,b,c* disposed in flow communication with the respective manifolds 58*a*, 60*a*, 62*a* of the respective first, second, and third inlet holes 58, 60, 62 for independently controlling flow of electrolyte 24 therethrough. The valves 64*a–c* are adjustable for discharging the electrolyte 24 into the inner cell 12 through the first inlet holes 58 at a flow rate of about an order of magnitude less than the flow rate of the electrolyte 24 being discharged into the outer cell 42 through the second and third inlet holes 60, 62. For example, the flow rate of the electrolyte 24 through the first inlet holes 58 may be within the range of about 0.4 liters per minute (l/m) to about 1.1 l/m, and the combined flow rate from the second and third inlet holes 60, 62 may be within the range of about 8–22 l/m. It is desirable to introduce the electrolyte 24 into the inner cell 12 with minimal velocity and disruption of the flow agitation therein. Unidirectional flow of the electrolyte 24 adversely affects the ability to obtain uniform electroplating of the article 14, and therefore, relatively slow introduction of the electrolyte 24 into the inner cell 12 is desired, with agitation of the electrolyte 24 therein being provided substantially only by the paddle 28 itself. And, by introducing the electrolyte 24 through the first inlet holes 58 in the middle of the inner cell floor 12*a*, its affect on the chemical reactions occurring at the cathodic article 14 and the anode 22 should be reduced. In the exemplary embodiments illustrated in FIG. 2, the depth D or lateral distance between the article 14 and the rack 18 and the anode 22 is about 12.9 cm.

Referring again to FIGS. 1 and 2, the top 42*b* of the outer cell 42 is preferably open to provide ready access to the inner cell 12 and other components therein. In particular, the first side cavity 44*b* is preferably open at its top and is suitably sized for vertically receiving the rack 18 therein for being positioned against the inner cell first open end 12*e*. In this way, the rack 18 including the article 14 therein may be simply loaded vertically downwardly into the first side cavity 44*b* into position adjacent to the inner cell first open end 12*e* prior to commencement of the electroplating process. In one embodiment (not illustrated) the outer cell front and back walls 42*c,d* may have suitable grooves therein in which the respective edges of the rack 18 may be channeled downwardly into final position for closing the first open end 12*e* of the inner cell 12. However, friction between the sliding rack 18 and such cell grooves may liberate small particles which can circulate in the electrolyte 24 and possibly contaminate the electrodeposition of the article 14.

Accordingly, in the preferred embodiment of the invention, the first side cavity 44*b* is sufficiently large so that the rack 18 may be firstly loaded vertically downwardly therein without contacting any solid surfaces therein, and then suitably translated horizontally to contact the inner cell 12 and close the first open end 12*e* thereof, As shown in FIG. 2, a suitable actuator in the exemplary form of an extendable and retractable piston 66 is suitably supported on the outer cell first sidewall 42*e* opposite the inner cell first open end 12*e*, and is effective for selectively pushing the rack 18 horizontally flat against the ends of the floor 12*a* and ceiling 12*b* of the inner cell 12 to close the inner cell first open end 12*e*, In the exemplary embodiment illustrated in FIG. 2, a suitable, flexible bellow 68 is sealingly joined to the piston 66 and the outer cell first sidewall 42*e* and is suitably provided with air under pressure for translating the piston 66 against the back side of the rack 18 when desired for horizontally positioning the rack 18 against the inner cell 12. Upon release of the air pressure within the bellows 68, suitable spring force is provided by the bellows for retracting the piston 66 away from the rack 18 for allowing its removal. FIG. 2 illustrates in phantom line the initial position of the rack 18 after being vertically loaded downwardly into the first side cavity 44*b*, and then upon actuation of the piston 66 the rack 18 is translated horizontally to the right in abutting contact against the inner cell 12 as shown in solid line. In this way, friction-created particulates are reduced or eliminated during the loading and unloading of the rack 18.

Various configurations may be used for loading and unloading the rack 18 into the outer cell 42. As illustrated in FIGS. 2–4, the rack 18 may include an inverted U-shaped hook 18*h* at its upper end which is suitably removably suspendable from a crossarm 70 extending across the outer cell 42 from the front to back walls 42*c,d* thereof. In the exemplary embodiment illustrated in FIGS. 3 and 4, suitable saddles 72 are integrally formed at the top ends of the respective front and back walls 42*c*, 42*d* on which the crossarm 70 may simply rest. In this way, the rack 18 may be loaded vertically downwardly into the first side cavity 44*b* with the hook 18*h* being simply captured on the crossarm 70. Upon actuation of the piston 66, the entire rack 18 and the crossarm 70 may be translated horizontally toward the inner cell 12, with the crossarm 70 sliding on the saddles 72.

Similarly, the outer cell second side cavity 44*c* is preferably also open at the top so that the anode 22 may be suitably loaded and unloaded in the vertical direction by grasping a suitable handle 22*h* at the top thereof. Suitable grooves in the front and back walls 42*c,d* may be used for guiding the anode 22 during its translation.

Figure 5:
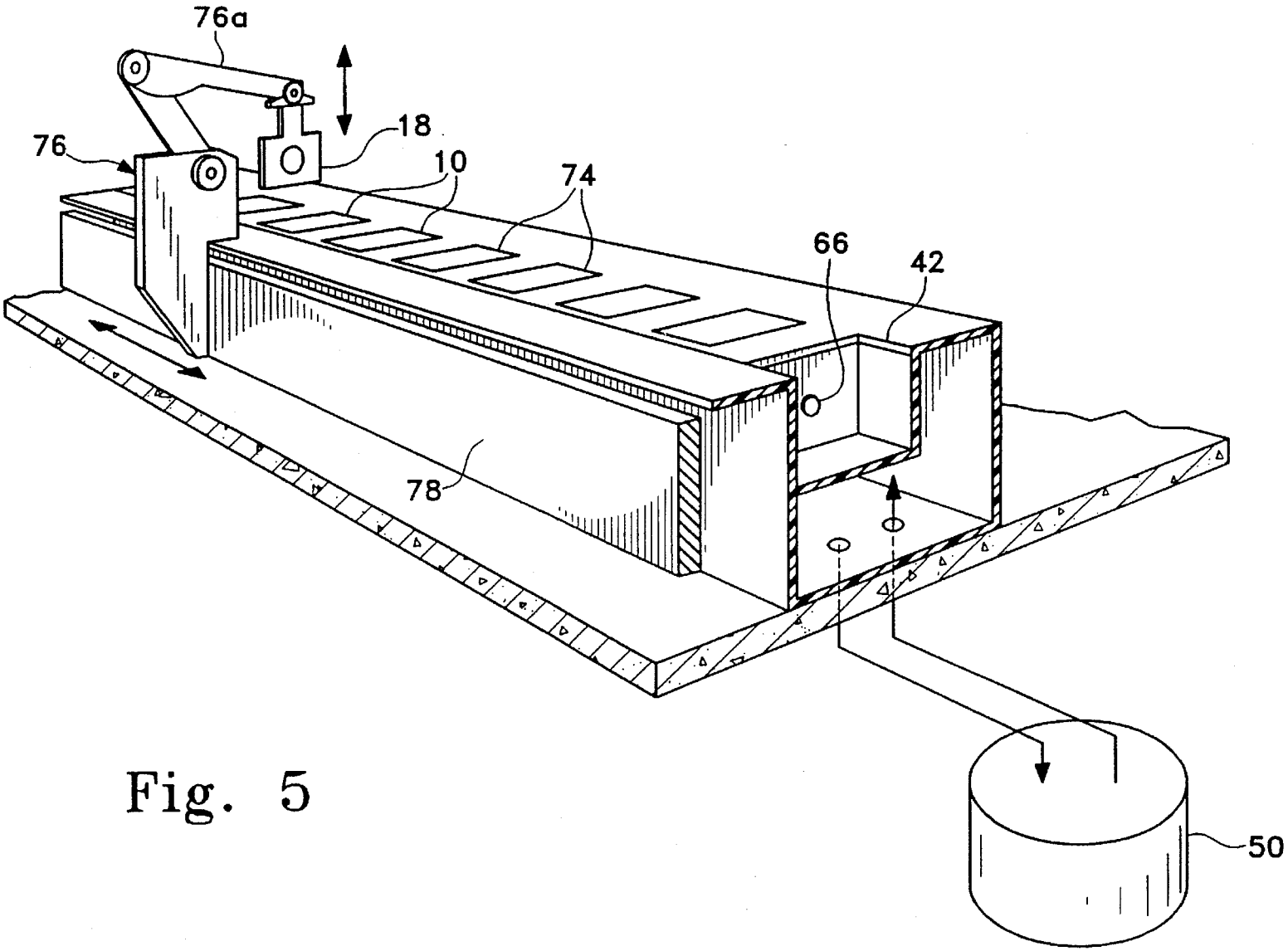
FIG. 5 is a schematic representation of the VPPC illustrated in the above Figures located in an automated handling line.

The above configuration of the VPPC 10 not only is effective for providing uniform electroplating on the article 14, but allows such electroplating to be automated. For example, illustrated schematically in FIG. 5 is a bank of several VPPCs 10 along with various rinsing tanks 74 arranged in a line for obtaining automated handling. A suitable transport crane or robot 76 is selectively movable along a rail 78 disposed adjacent to the outer cells 42 of the VPPCs. The robot 76 includes a selectively movable arm 76*a* which is effective for transporting the rack 18 both horizontally along the rail 78 as well as vertically into and out of the outer cell first cavity 44*b* (see FIG. 2) to close the inner cell first open end 12*e*. In this way, the single rack 18 with the article 14 thereon may be moved between the VPPCs 10 and the tanks 74 within the processing line.

Accordingly, the VPPC 10 as described above has the capability for allowing loading and unloading of the rack 18 with the workpiece 14 thereon by relatively simple automatic handling equipment suitable for high-volume manufacturing. Since the anode 22 is vertically oriented rather than horizontal and facing down, there is less tendency for contamination of the article 14 from particle release at the anode 22. And, it is not necessary to remove the anode 22 while loading and unloading the cathode as is typically required in horizontal electroplating. This is particularly significant in applications such as acid copper sulphate plating where a delicate anode film must be protected from disruption.

Since the cathode, e.g. the article 14, is also disposed vertically, there is no tendency for contamination caused by particles settling by gravity onto the article 14. Generation of particles by friction is also reduced due to the ability to load and unload vertically, and most significantly by the vertical and horizontal loading sequence described above.

The electrodeposition of metal films on the article 14 having a uniform thickness and composition equal to or better than that available from conventional horizontal plating cells may be obtained. The inner cell floor 12*a* and ceiling 12*b* provide "false" floors and ceilings submerged within the outer cell 42 to provide current guides between the cathode and anode for preventing undesirable flux spreading which would otherwise adversely affect uniformity of electroplating, as well as provide flow boundaries for the electrolyte 24 being agitated by the paddle 28. And, mild circulation to the inner cell 12 is introduced through the first inlet holes 58 near the middle of the floor 12*a* between the anode and cathode without degradation of electroplating uniformity.

Although the invention has been described for the preferred embodiment of performing electrodeposition, it may also be used for electroless plating without providing electrical potentials at the rack 18 and the anode 22, with the anode 22 merely being a simple sidewall, of PVDF for example, for maintaining the closure of the six-sided inner chamber 12*g* to obtain reproducible fluid flow patterns therein and uniform plating therefrom.

The invention may also be used for electroetching, with the rack 18 being maintained as an anode, and the sidewall 22 being maintained as a cathode. Or, chemical etching may be practiced without providing electrical potentials at the rack 18 and the sidewall 22.

In all embodiments, the closed inner chamber 12*g* provides a predetermined flow boundary within which the paddle 28 provides effective agitation and fluid flow patterns which are accurately reproducible for repetitive, high-volume use of the apparatus in a manufacturing plant.

While there have been described herein what are considered to be preferred and exemplary embodiments of the present invention, other modifications of the invention shall be apparent to those skilled in the art from the teachings herein, and it is, therefore, desired to be secured in the appended claims all such modifications as fall within the true spirit and scope of the invention.

Accordingly, what is desired to be secured by Letters Patent of the United States is the invention as defined and differentiated in the following claims:

We claim:

1. A cell for use in electroplating a flat article comprising:

a floor and a parallel ceiling spaced therefrom;

a front wall and a parallel back wall spaced therefrom, and being fixedly joined to said floor and ceiling in a quadrilateral configuration having opposite first and second open ends;

a rack for supporting said article being removably positioned vertically to close said first open end, and including a thief for laterally surrounding said article and being coplanar therewith to define a cathode;

an anode being positioned vertically to close said second open end;

said floor, ceiling, front wall, back wall, rack, and anode defining a substantially closed, six-sided inner chamber for receiving an electrolyte therein for electroplating said article upon establishing current flow between said cathodic article and said anode;

said thief, for surrounding said article being coextensively aligned with said anode; and said floor, ceiling, front wall, and back wall being effective for guiding electrical current flux between said cathode and said anode.

2. A cell according to claim 1 wherein said rack is configured for supporting said article symmetrically relative to said floor, ceiling, front wall, and back wall.

3. A cell according to claim 1 in combination with:

a paddle disposed vertically inside said inner chamber adjacent to said rack; and means for reciprocating said paddle between said front and back walls for agitating said electrolyte inside said inner chamber.

4. A combination according to claim 3 wherein said paddle comprises a pair of vertically elongate, triangular prisms having spaced apart, parallel apexes defining therebetween a throat through which said electrolyte is flowable, and further having oppositely facing, parallel flat bases, with one of said bases being disposed parallel and adjacent to said rack for parallel movement over said article supported therein.

5. A combination according to claim 3 wherein:

said floor and said ceiling each have an elongate slot extending between said front and back walls, and parallel to said rack; and said reciprocating means include:

a bottom arm fixedly joined to said paddle at a bottom end thereof and extending through said floor slot;

a top arm fixedly joined to said paddle at a top end thereof and extending through said ceiling slot;

a crossbar joined to both said top and bottom arms above said ceiling; and an actuator effective for translating said crossbar back-and-forth above said ceiling for correspondingly reciprocating said paddle inside said inner chamber.

6. A combination according to claim 5 wherein said reciprocating means further include a controller effective for controlling said actuator to translate said paddle from said front wall to said back wall with a predetermined velocity profile as said paddle travels over said article in said rack.

7. A combination according to claim 3 wherein said anode comprises a box having a perforated face facing said inner chamber opposite said rack, and said box includes anodic material.

8. A combination according to claim 3 wherein said cell is an inner cell, and further comprising:

an outer cell having said inner cell fixedly disposed therein and including a floor and first and second sidewalls extending vertically upwardly from opposite ends thereof above said inner cell, with said outer cell floor being spaced below said inner cell floor to define a bottom cavity, said outer cell first sidewall being spaced from said inner cell first open end to define a first cavity, and said outer cell second sidewall being spaced from said inner cell second open end to define a second cavity; and wherein said outer cell is fillable with said electrolyte to a level above said inner cell for completely filling said inner chamber with said electrolyte.

9. A combination according to claim 8 further comprising:

an outlet weir disposed in said outer cell second sidewall at an elevation above said inner cell;

bathing means for filling said inner and outer cell with said electrolyte to said weir elevation above said inner cell for overflow discharge from said outlet weir, and for continuously recirculating said electrolyte through said inner cell.

10. A combination according to claim 9 wherein said bathing means comprise:

a plurality of first inlet holes disposed in said inner cell floor adjacent to said floor slot, said first inlet holes being spaced from each other and colinearly aligned parallel to said floor slot for uniformly discharging said electrolyte vertically upwardly into said inner chamber; and said ceiling slot provides an outlet from said inner cell for discharging said electrolyte therefrom and into said outer cell below said weir elevation therein.

11. A combination according to claim 10 wherein said bathing means further comprise:

an outlet trough fixedly joined to said outer cell second sidewall in flow communication with said outlet weir for receiving overflow of said electrolyte therefrom;

an external reservoir for storing said electrolyte;

a flow conduit joining said outlet trough, said reservoir, and said inner cell in a fluid circuit;

a pump disposed in said flow conduit for continuously recirculating said electrolyte in said fluid circuit; and a filter disposed in said flow conduit for filtering said electrolyte prior to return thereof to said inner cell.

12. A combination according to claim 11 wherein said bathing means further comprises:

a plurality of spaced apart and linearly aligned second inlet holes disposed in said outer cell floor below said first cavity and in flow communication with said filter for receiving said electrolyte therefrom; and a plurality of spaced apart and linearly aligned third inlet holes disposed in said outer cell floor below said second cavity and in flow communication with said filter for receiving said electrolyte therefrom.

13. A combination according to claim 12 wherein said bathing means further comprise respective valves for separately controlling flow of said electrolyte to said first, second, and third inlet holes, and said valves are effective for discharging said electrolyte into said inner cell through said first inlet holes at a flowrate about an order of magnitude less than the flow rate of said electrolyte dischargeable into said outer cell through said second and third inlet holes.

14. A combination according to claim 8 wherein said first cavity is open at a top thereof and is sized for vertically receiving said rack for being positioned against said inner cell first open end.

15. A combination according to claim 14 further comprising an extendable piston supported on said outer cell first sidewall opposite said inner cell first open end, and being effective for pushing said rack horizontally against said inner cell floor and ceiling to close said inner cell first open end.

16. A combination according to claim 14 wherein:

said outer cell further includes front and back walls defining with said first and second sidewalls and said floor thereof a five-sided chamber being open at a top thereof; and said rack is removably suspendable from a crossarm extending across said outer cell from said front to back walls thereof.

17. A combination according to claim 16 further comprising:

a transport robot selectively removable along a rail disposed adjacent to said outer cell, said robot including a selectively movable arm effective for transporting said rack vertically into said outer cell first cavity to close said inner cell first open end, and for vertical removal therefrom.

18. An apparatus for use in plating or etching a flat article comprising:

a floor and a parallel ceiling spaced therefrom;

a front wall and a parallel back wall spaced therefrom, and being fixedly joined to said floor and ceiling in a quadrilateral configuration having opposite first and second open ends;

a rack for supporting said article being removably positioned vertically to close said first open end;

a sidewall being positioned vertically to close said second open end;

said rack for supporting said article being coextensively aligned with said sidewall;

a paddle disposed vertically inside said inner chamber adjacent to said rack;

means for reciprocating said paddle between said front and back walls for agitating a fluid inside said inner chamber; and said floor, ceiling, front wall, back wall, rack, and sidewall defining a substantially closed, six-sided inner chamber for receiving said fluid therein for plating or etching said article, and being effective for providing a predetermined flow boundary for obtaining reproducible fluid flow patterns therein.

19. An apparatus according to claim 18 wherein said paddle comprises a pair of vertically elongate, triangular prisms having spaced apart, parallel apexes defining therebetween a throat through which said fluid is flowable, and further having oppositely facing, parallel flat bases, with one of said bases being disposed parallel and adjacent to said rack for parallel movement over said article supported therein.

20. An apparatus according to claim 19 wherein:

said floor and said ceiling each have an elongate slot extending between said front and back walls, and parallel to said rack; and said reciprocating means include:

a bottom arm fixedly joined to said paddle at a bottom end thereof and extending through said floor slot;

a top arm fixedly joined to said paddle at a top end thereof and extending through said ceiling slot;

a crossbar joined to both said top and bottom arms above said ceiling; and an actuator effective for translating said crossbar back-and-forth above said ceiling for correspondingly reciprocating said paddle inside said inner chamber.

21. An apparatus according to claim 20 wherein said reciprocating means further include a controller effective for controlling said actuator to translate said paddle from said front wall to said back wall with a predetermined velocity profile as said paddle travels over said article in said rack.

* * * * *